US006705800B2

(12) United States Patent
Ring et al.

(10) Patent No.: US 6,705,800 B2
(45) Date of Patent: Mar. 16, 2004

(54) LIQUID DRAINAGE SYSTEM WITH COVER

(75) Inventors: Carl D. Ring, Oakland, TN (US); Douglas M. Dygert, Olive Branch, MS (US); Thomas K. Weaver, Brevard, NC (US)

(73) Assignee: Ring Industrial Group, LP, Oakland, TN (US)

( * ) Notice: Subject to any disclaimer, the term of this patent is extended or adjusted under 35 U.S.C. 154(b) by 20 days.

(21) Appl. No.: 10/166,533

(22) Filed: Jun. 11, 2002

(65) Prior Publication Data

US 2003/0228194 A1 Dec. 11, 2003

(51) Int. Cl.[7] ..... E02B 11/00
(52) U.S. Cl. ..... 405/46; 405/45; 405/53
(58) Field of Search ..... 405/49, 48, 47, 405/46, 45, 44, 43, 36, 157, 189.4

(56) References Cited

U.S. PATENT DOCUMENTS

| | | | | | |
|---|---|---|---|---|---|
| 980,442 | A | * | 1/1911 | Schlafly | 405/48 |
| 2,637,170 | A | | 5/1953 | Benedict | |
| 3,220,194 | A | | 11/1965 | Lienard | |
| 3,933,181 | A | | 1/1976 | Nilsson et al. | |
| 4,119,751 | A | | 10/1978 | Nilsson et al. | |
| 4,145,157 | A | | 3/1979 | Lascelles | |
| 4,329,084 | A | * | 5/1982 | Chapa | 405/157 |
| 4,605,338 | A | * | 8/1986 | Peterson | 405/157 |
| 5,015,123 | A | | 5/1991 | Houck et al. | |
| 5,160,218 | A | * | 11/1992 | Hill | 405/184.4 |
| 5,890,838 | A | | 4/1999 | Moore et al. | |
| 6,129,482 | A | * | 10/2000 | Ditullio | 405/43 |
| 6,273,641 | B1 | * | 8/2001 | Bull | 405/157 |
| 6,443,652 | B1 | * | 9/2002 | Houck et al. | 405/46 |
| 6,467,995 | B2 | * | 10/2002 | Bevilacqua et al. | 405/48 |

* cited by examiner

*Primary Examiner*—Frederick L. Lagman
(74) *Attorney, Agent, or Firm*—David A. Tamburro

(57) ABSTRACT

A drainage system for delivering fluid from a source of fluid for absorption into the ground, comprises a trench, a pair of perforated drainage conduits extending longitudinally in said trench and laterally spaced from each other to define an open chamber therebetween. The conduits are connected at one end to the source for receiving fluid from the source and delivering fluid to the chamber. A longitudinally extending cover overlies said conduits and prevents soil from falling into the chamber. The cover includes side portions which engage the conduits and a center portion connected to the side portions and maintains the conduits in laterally spaced relationship. The cover also includes reinforcing arches extending between the side portions and the center portion to resist downward deflection of the cover under the weight of the top soil. Vent holes in the cover permit the system to breathe.

18 Claims, 5 Drawing Sheets

LIQUID DRAINAGE SYSTEM WITH COVER

BACKGROUND OF THE INVENTION

This invention relates generally to liquid drainage systems used on site for footings, open trenches or nitrification fields used as discharge points for septic tanks, and more particularly to a novel drainage system which is easy to install and which maximizes the size of a storage chamber or area for the liquid until it can be absorbed by or percolated into the surrounding soil.

In the past conventional drainage systems have typically comprised a horizontally extending perforated conduit placed within a drainage trench and surrounded by a quantity of loose aggregate material such as rock or crushed stone and covered with compacted soil. The space between the conduit and ground occupied by the aggregate serves to define a drainage cavity in fluid communication with the perforations of the conduit. An example of such a drainage system is found in the nitrification field of conventional ground absorption sewage disposal systems wherein effluent is discharged form a septic tank through the perforated vent pipe of a nitrification line which is surrounded by aggregate material such as rocks or crushed stone. The nitrification field creates a storage chamber or area for the sewage affluent until it can be absorbed by the soil.

These conventional systems suffer a number of drawbacks as discussed in U.S. Pat. No. 5,015,123 (owned by the assignee of this invention), and the novel drainage system described and claimed in the '123 patent represents a substantial improvement over the conventional system. The description of that improved system as set forth in the '123 patent is incorporated herein by reference in its entirety. Briefly, that system utilizes pre-assembled drainage line units illustrated in FIG. 2 of the patent in which loose aggregate in the form of lightweight materials is provided in surrounding relationship to a perforated conduit and bound thereby by a perforated sleeve member. These units used in combination with pre-assembled units illustrated in FIG. 3 of the patent which do not include the perforated pipe replace the gravel system used in the conventional systems as illustrated in FIGS. 4*b* and 4*c* of the patent to provide the storage chamber or area for the effluent until it can be absorbed by the soil. The system of the '123 patent represents a substantial improvement over the prior conventional gravel system for the reasons set forth in the '123 patent and has enjoyed substantial commercial success.

Recently, another drainage system has been proposed which includes a pair of drainage pipes such as those illustrated in FIG. 2 of the '123 patent extending longitudinally within the trench and laterally spaced from each other to define an open storage chamber and a cover placed on top of and spanning the laterally spaced pipes to prevent top dirt fill from falling down into the storage chamber. While this system conceptionally shows some promise, the design of the cover has not been strong enough to support the weight of the top fill dirt and bends and deflects downwardly to decrease the size of the storage chamber and reduce the overall efficiency of the drainage system.

Thus, there is a need in this most recent proposal for a cover which has sufficient strength and stability to support the weight of the top fill dirt and thereby avoid the problem associated with prior covers. The cover of this invention as described and claimed herein below was developed to perform that task.

SUMMARY OF THE INVENTION

Accordingly, the primary object of this invention is to provide a drainage system which includes a pair of longitudinally extending drain pipes placed within a drainage trench laterally spaced from each other to define a liquid storage chamber therebetween and a novel cover placed on top of the drain pipes. The cover is sufficiently strong and stable to support the weight of the fill dirt placed on top thereof, thereby substantially maintaining the chamber at its original size for storage of the drainage liquid until it can be absorbed by the soil defining the bottom of the trench.

Another object of the invention is to provide the above drainage system wherein the novel cover includes two side portions extending longitudinally over and generally conforming to the shape of the drain pipes and a center portion connecting the two side portions to maintain the drain pipes in laterally spaced relationship, the cover further including reinforcing elements extending between the side portions and the center portion to prevent downward deflection of the center portion under the weight of the top soil. As a result the size of the chamber is maintained to create maximum storage area for the liquid drainage until it can be absorbed by or percolated into the soil at the bottom of the trench.

A further object of the invention is to provide various embodiments of the novel cover which can be used in the above described drainage system and wherein all of the embodiments contain reinforcement elements which prevent downward deflection of the cover under load.

Still another object of the invention is to provide a novel cover as described above wherein the cover includes a plurality of vented openings which allows the system to breathe to thereby retard development of the clogging mat within the chamber, that is the mechanical loss of infiltrative capacity at the soil surface interface due to suspended solids, bacteria growth and ferrous sulfide precipitation.

Other objects and advantages of the invention will become apparent from reading the following detailed description of the invention wherein reference is made to the accompanying drawings.

DETAILED DESCRIPTION OF THE INVENTION

Figure 1:
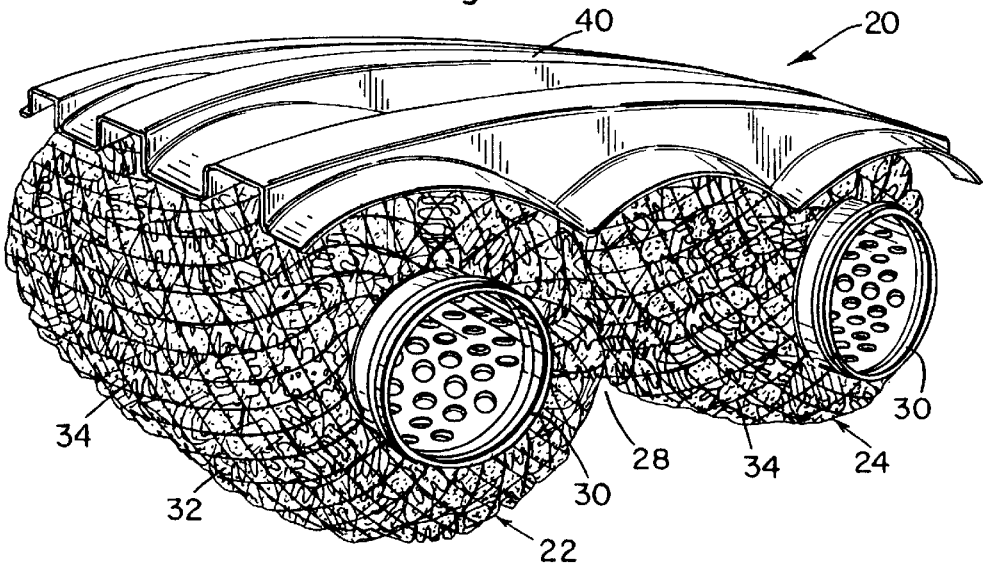
FIG. 1 is an end perspective of a fragmentary portion of the drainage system and cover of the invention illustrated with pre-assembled drainage units such as those illustrated in FIG. 2 of U.S. Pat. No. 5,015,123.
Figure 2:
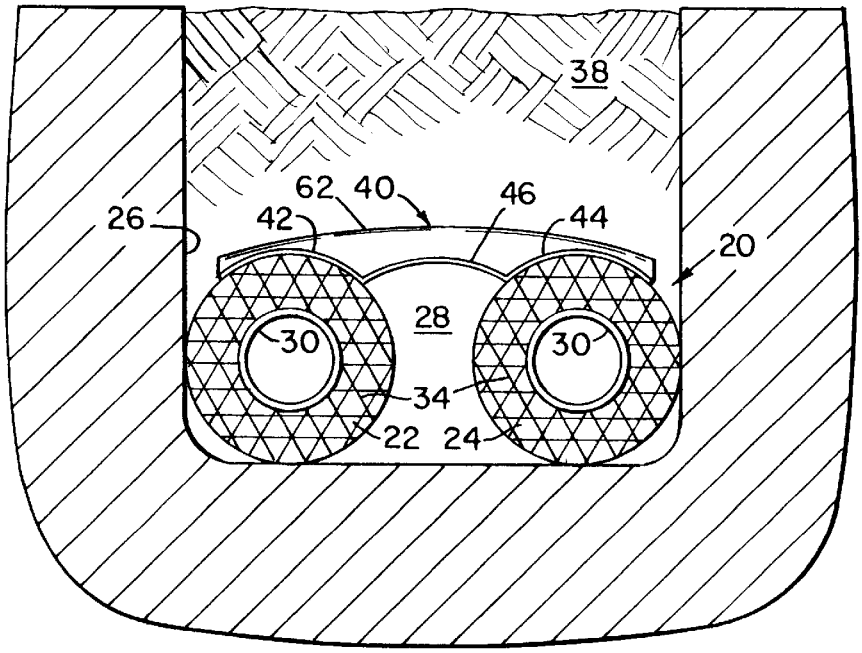
FIG. 2 is a fragmentary end section illustrating the drainage system placed within a drainage trench.
Figure 3:
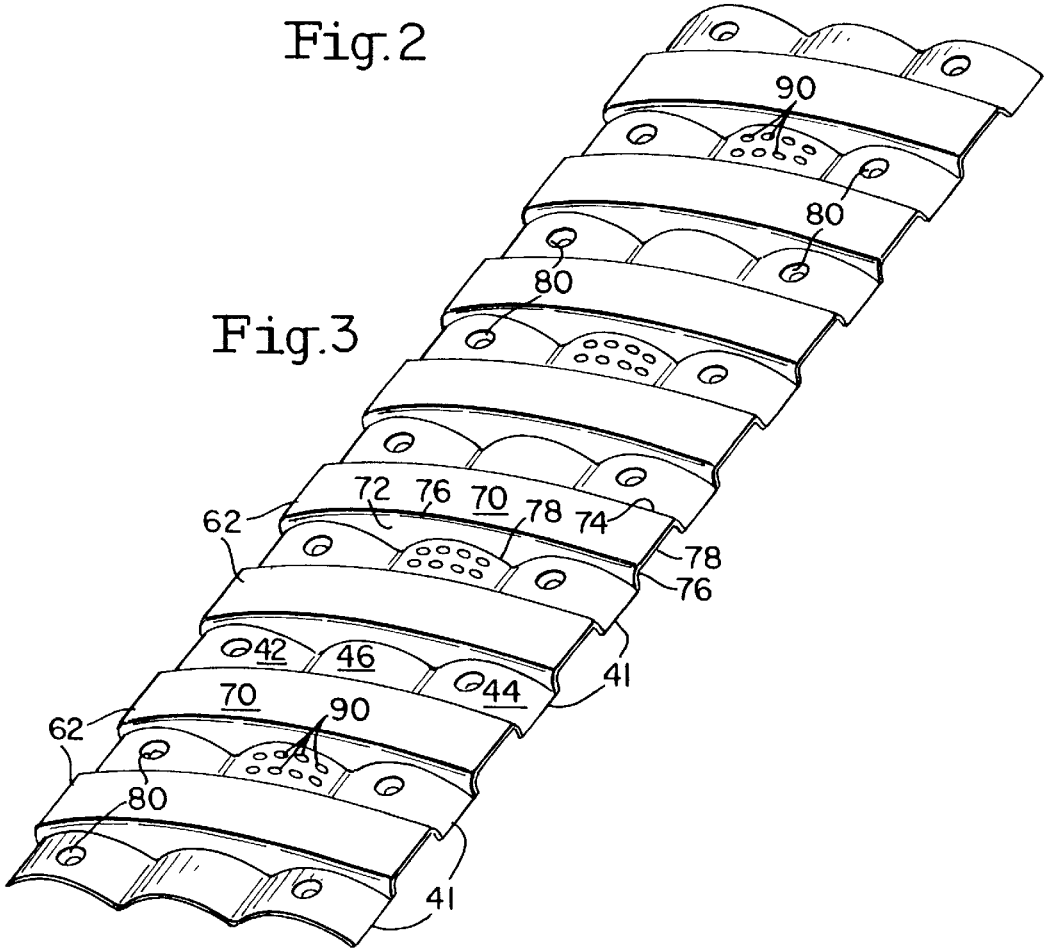
FIG. 3 is a top perspective view of a first embodiment of the novel cover which may be employed in the system of FIG. 1.
Figure 4:
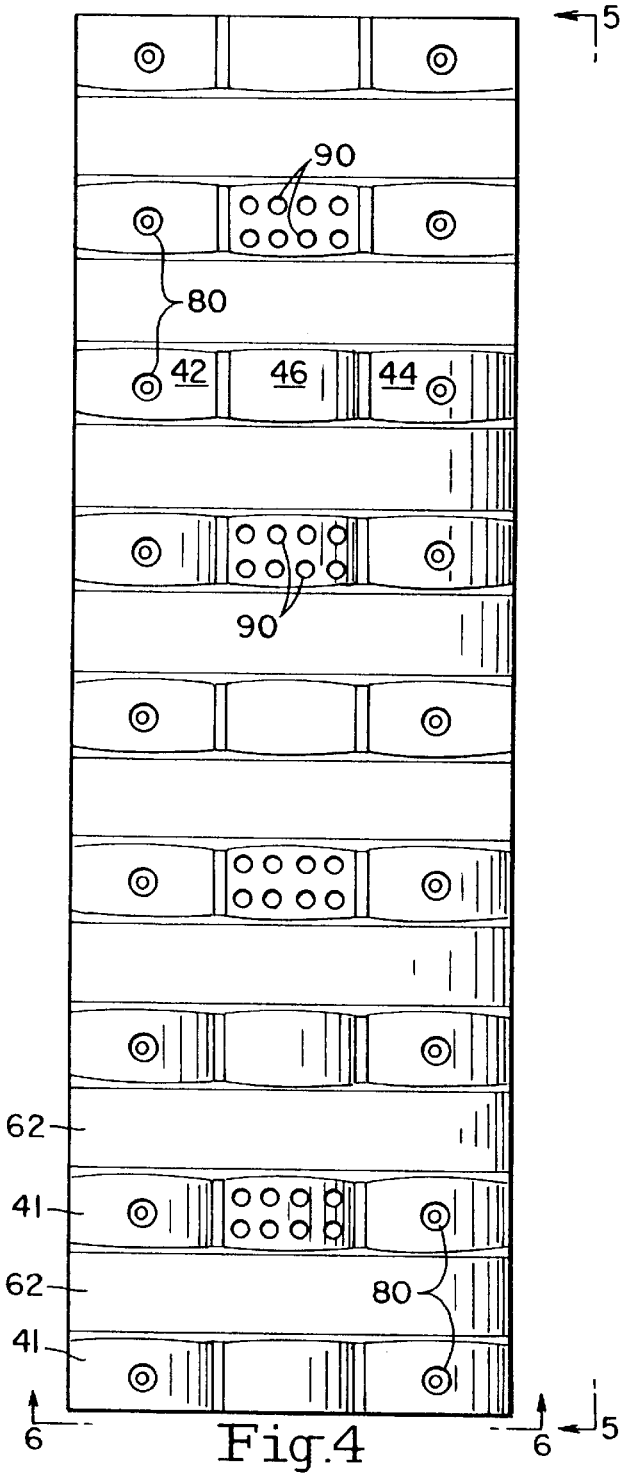
FIG. 4 is a top plan view of the cover illustrated in FIG. 3.
Figure 5:
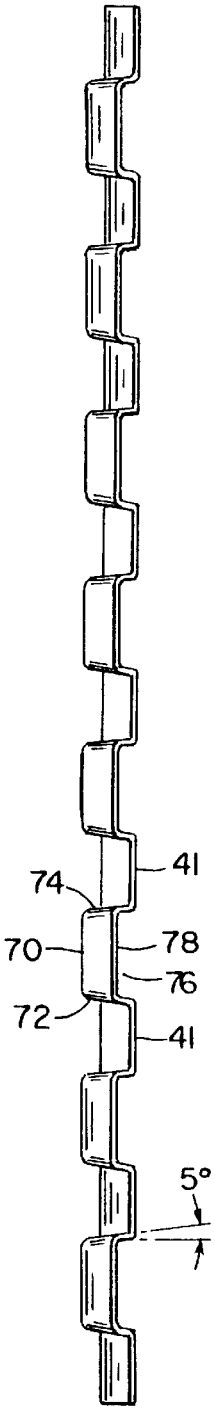
FIG. 5 is a side view of the cover taken along line 5—5 of FIG. 4.
Figure 6:
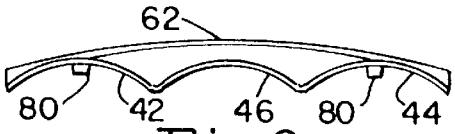
FIG. 6 is an end view of the cover taken along line 6—6 of FIG. 4.

FIGS. 1 and 2 generally illustrate the drainage system 20 with which the invention is concerned and include a pair of horizontal perforated drain pipe units 22 and 24 placed within and extending longitudinally along trench 26 and laterally spaced from each other to provide the central open chamber 28. While drain pipe units 22 and 24 may be of various types, they are preferably pre-assembled drainage units such as those illustrated in FIG. 2 of U.S. Pat. No. 5,015,123 and include a central perforated pipe 30 surrounded by a plurality of lightweight plastic aggregate 32 held in place by a surrounding net 34.

A cover 40 constructed according to the first embodiment of FIGS. 3–6 extends across the top of drainage units 22 and 24 and includes a retaining section 41 having side portions 42 and 44 which conform in shape and size to the outer surface and configuration of pipe units 22 and 24, and a center portion 46 connected to the side portions and functioning to maintain the pipe units 22 and 24 in laterally spaced relation to form the center chamber 28. In a typical installation the width of trench 26 may be 24 inches and the depth may be approximately 22 inches. Units 22 and 24 may be approximately 10 inches in diameter and the perforated pipe 30 within the units may be approximately 4 inches in diameter. When the storage system 20 is placed within the trench the distance between the top of the cover and the top of the trench will be approximately 10 to 11 inches and the space defined thereby will be filled with top soil 38 which was removed from the trench originally. In such an installation, assuming the density of the soil to be about 96 pounds per cubic feet, the weight or load imposed upon cover 40 and system 20 will be about 100 pounds per square foot.

The prior art plastic cover 50 illustrated in FIGS. 12, 13 and 14 and described hereinabove, included a pair of elongated continuous side sections 51 and 52 of generally circular configuration to conform to the outside surface of drainage units 22 and 24 and an inverted V-shaped center section 53 joined to sections 51 and 52 along sharp junction lines 54 and 55. Recessed depressions 56 are provided in center section 53 to prevent the flattening at the apex of that section under load. Each of the side sections 51 and 52 include a plurality of downwardly projecting lugs or dimples 57 which penetrate into the outer surface of units 22 and 24 and help to hold those units in their laterally spaced relation in the same manner as shown in FIG. 2.

In storage systems such as this liquid is fed into one end of the perforated pipes 30 from a collection basin or from a septic tank and passes outwardly through the perforations in the pipe and the lightweight aggregate into chamber 28 where it is collected and stored until it can be absorbed by or percolated into the soil defining the trench. It is desirable that the liquid or effluent storage area defined by units 22 and 24 and space 28 substantially maintain its original size so as to maximize the efficiency of the drainage system.

Figure 12:
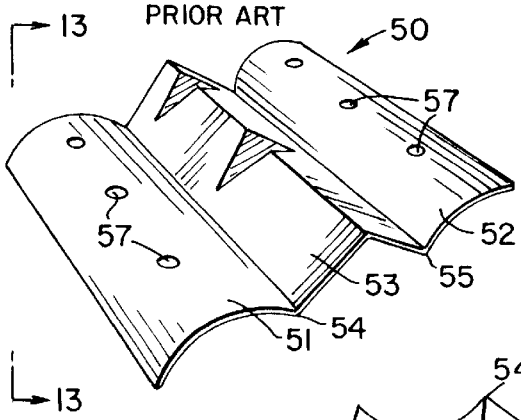
Fig.12 PRIOR ART
FIG. 12 is a top perspective view of the prior art cover referred to above under the Background of the Invention.
Figure 13:
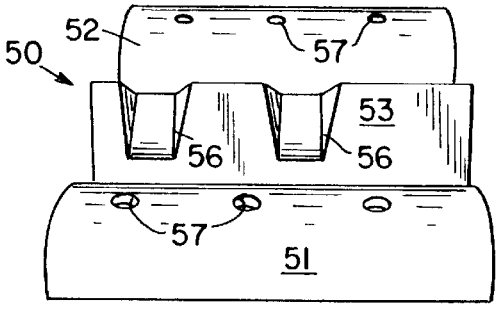
Fig.13 PRIOR ART
FIG. 13 is a side perspective view taken along line 13—13 of FIG. 12.
Figure 14:
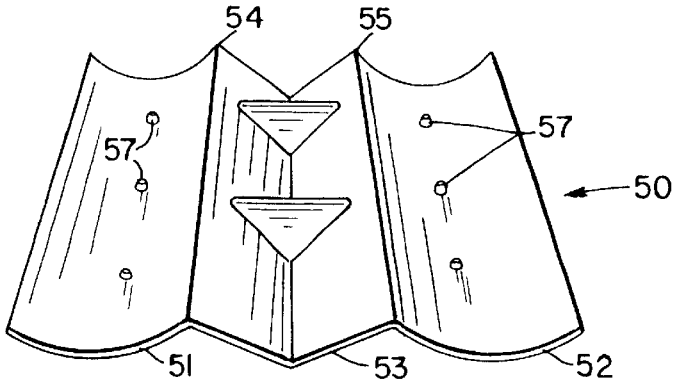
Fig.14 PRIOR ART
FIG. 14 is a bottom view of the prior art cover illustrated in FIG. 12.

Even though the prior art cover illustrated in FIGS. 12–14 was about 0.125 inches thick, it encountered substantial downward deflection under load of the top soil such as bending along the junction lines 54 and 55 and the tendency of the side sections 51 and 52 to flatten out under load. As a result the size of chamber 28 and the overall size of the storage area defined by the units 22 and 24 and chamber 28 decreased to reduce the drainage capacity and overall efficiency of the system.

Accordingly, applicants have developed the novel covers of FIGS. 3–6 and FIGS. 7–11 incorporating the invention which overcome the problems associated with the prior art design of FIGS. 12–14.

The first embodiment of the invention includes the one-piece cover 40 illustrated in FIGS. 1–6. Cover 40 is molded of plastic, preferably of high density polyethylene plastic and is constructed so as to be light in weight but yet strong enough to resist downward deflection under the weight of the top fill soil 38 placed therein to fill the upper portion of trench 26. For example in an installation such as in trench 26 shown in FIG. 2, the thickness of the cover may be about 0.080–090 inch, the width W may be about 21¼ inches and the length L may be any desired length for example, 63 inches long. The one piece cover 40 includes pipe retaining sections 41 and reinforcing sections 62 which alternate in corrugated undulating fashion along the length of the cover forming peaks and valleys defined by sections 62 and 41, respectively. Each section 41 includes side portions 42 and 44 which are shaped and configured to correspond to the outer shape of pipes 22 and 24 and are connected together by the central radiused portion 46. For example, in the configuration shown in FIG. 2 side portions 42 and 44 are formed on the radius of about 5 inches and the center portion is formed on a radius of about 4½ inches. Each reinforcing section 62 is formed on a single large radius to provide a crowned arch extending along the full width of the cover with each arch 70 being integrally joined to adjacent sections 41 by downwardly and outwardly tapering side walls 72 and 74, the upper edges 76 of which are radiused to avoid any sharp stress points. Similarly, the junction lines 78 at which walls 72 and 74 join sections 41 are radiused to avoid any stress points. The width of sections 41 and 62 along the longitudinal direction is essentially the same. For example about 3½ to 4 inches.

The radius on which arches 70 are formed is about 38½ inches, large enough so that the top surface of the arch at the longitudinal center of the cover is spaced about 1 inch above the center of the portion 46 and a hollow space 76 is created beneath the bottom surface 78 of the arch so that that bottom surface does not engage the pipes 22 and 24 in the drainage system as shown in FIG. 2.

Each portion 42 and 44 includes retaining lugs 80 which project downwardly from the bottom surface thereof and as illustrated in FIG. 2 are pressed into the outer surface of pipe assemblies 22 and 24 to help retain those pipes in spaced relationship within trench 26.

When placed in use as illustrated in FIG. 2, portions 42 and 44 of sections 60 engage the top of laterally spaced pipes 22 and 24 with the center section 68 overlying chamber 28. The sections 41 and 62 cooperate to completely cover pipes 22 and 24 and central chamber 28 to prevent any of the fill dirt 38 from falling down into the chamber. In addition the crowned arches 70 forming sections 62 and the tapered side walls 72 and 74 provide substantial strength and rigidity to the cover so that it is able to support the weight of the top soil and resist any significant downwardly deflection which would decrease the size of chamber 28 and the total liquid storage area defined by chamber 28 and pipes 22 and 24.

Cover 40 may also be provided with a plurality of vent holes 100 in sections 41 which allow the drainage system to breathe. This helps prevent the development of clogging mat in chamber 28. The sides of the holes 100 is smaller than the particles of soil 38 to prevent soil from falling into chamber 28.

Figure 7:
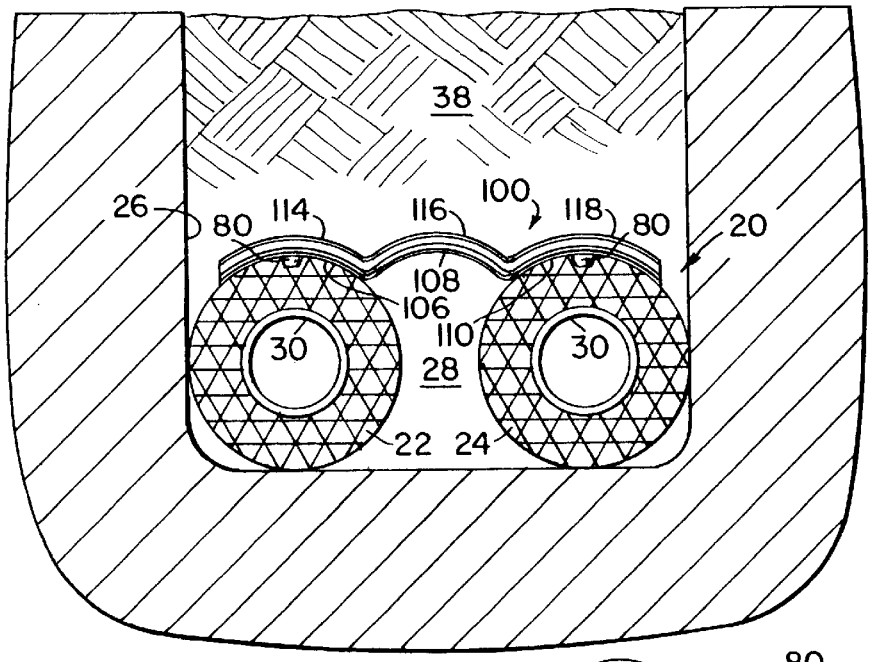
FIG. 7 is a view similar to FIG. 2 with the drainage system employing a second embodiment of the novel cover of the invention.
Figure 8:
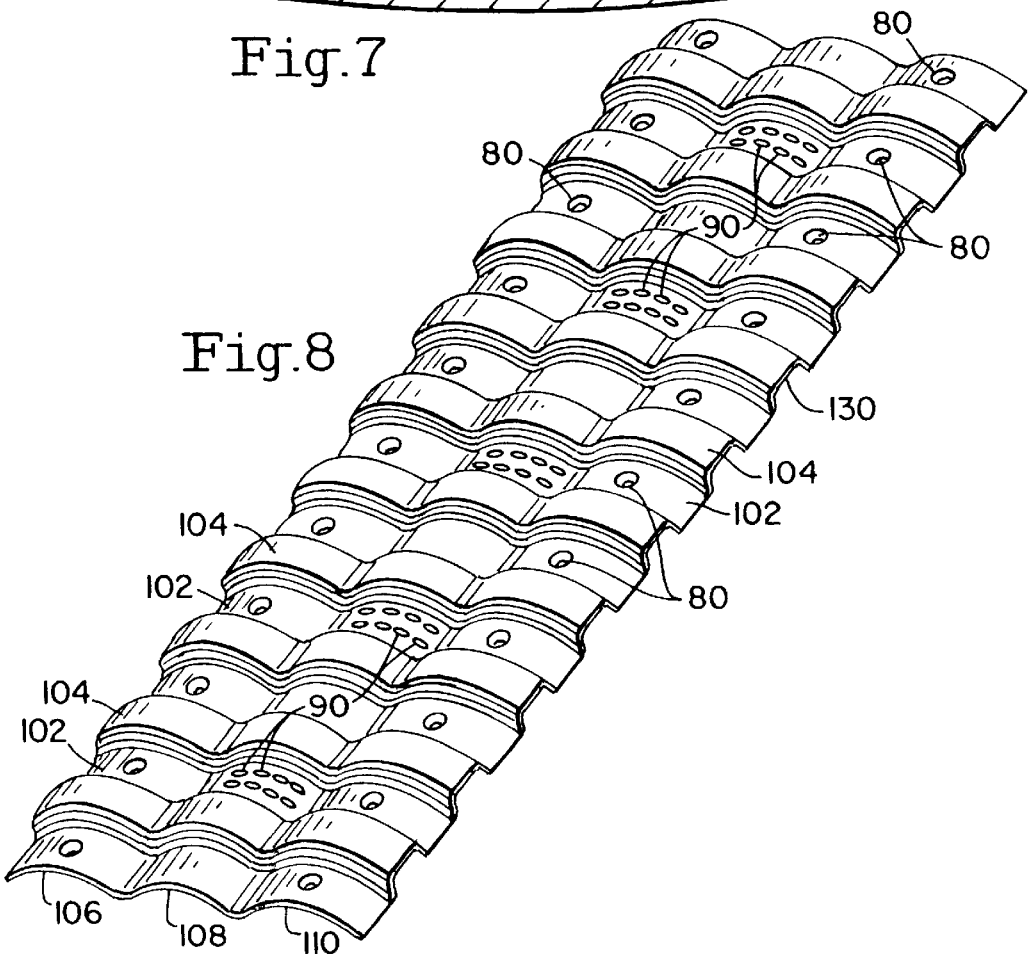
FIG. 8 is a top perspective view of the second embodiment of the cover shown in FIG. 7.
Figure 9:
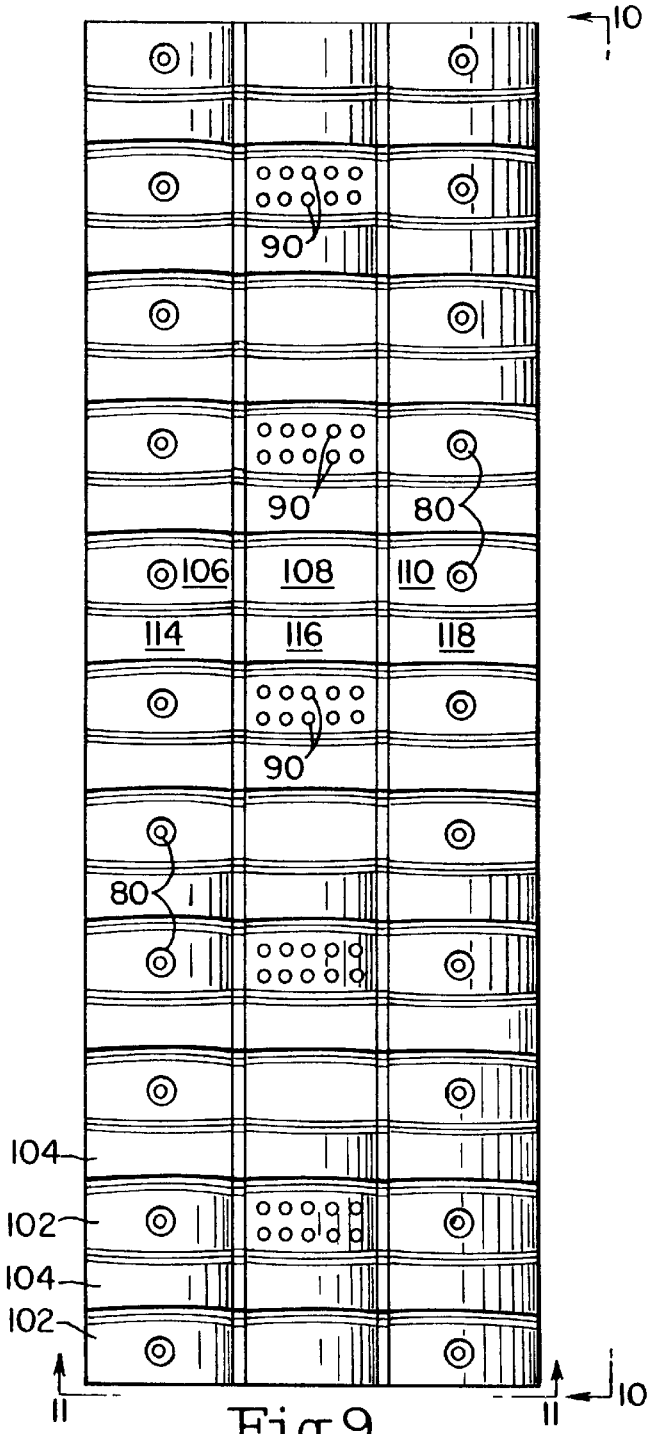
FIG. 9 is a top plan view of the cover illustrated in FIG. 8.
Figure 10:
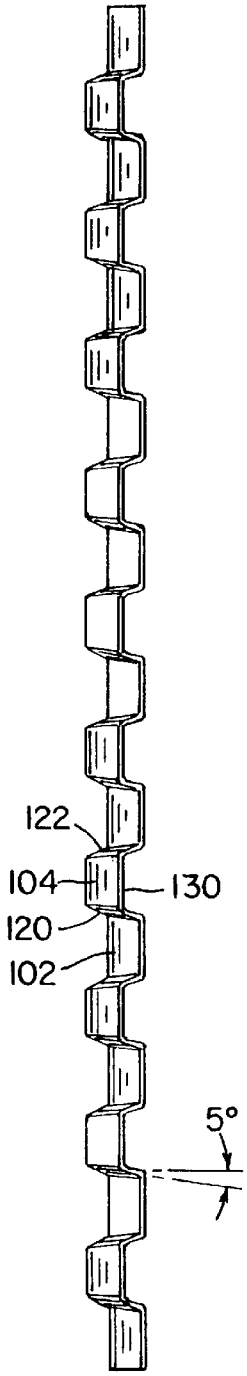
FIG. 10 is a side view of the cover taken along line 10—10 of FIG. 9.
Figure 11:
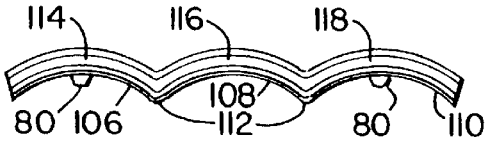
FIG. 11 is an end view of the cover taken along line 11—11 of FIG. 9.

A second embodiment of the invention is illustrated in FIGS. 7–11. The novel cover 100 mounted in place on pipe units 22 and 24 as illustrated in FIG. 7, similarly includes a plurality of retaining sections 102 and reinforcing sections 104 arranged in alternating fashion along the length of the cover to form valleys and peaks, respectively, in the same way as the construction of the first embodiment of the invention. Sections 102 include radiused sections 106, 108 and 110 joined along lines 112, with each of the sections 106, 108 and 110 being formed on the same radius, for example, 4.985 inches, to substantially conform to the outer radius of pipe units 22 and 24.

Each of the reinforcing sections 104 includes a plurality of radiused crowned arches 114, 116 and 118 longitudinally aligned with portions 106, 108 and 110 respectively. Crowned portions 114, 116, and 118 are formed on essentially the same radius as portions 106, 108 and 110 but on a raised center line so that the top surface of those portions extend above the top surfaces of portions 106, 108 and 110, for example about 1 inch thereabove, so as to provide the corrugated or undulating configuration of cover 100. Arches 114, 116 and 118 are connected to portions 106, 108 an 110 by way of side walls 120 and 122 which taper downwardly and outwardly at an angle of about 5 degrees from sections 104 to sections 102.

The raised crown arches 114, 116 and 118 of section 104 provide a hollow space 130 therebelow so that the bottom surfaces of those crowned arches do not contact the pipe units when installed in place.

The width of sections 102 in the longitudinal direction is slightly larger than the width of sections 104. For example, the width of sections 102 may be about 3½ inches whereas the width of sections 104 may be about 2½ inches.

As shown in FIG. 7, cover 100 mounts on pipe units 22 and 24 and functions in much the same way as cover 40 shown in FIG. 2. The raised crown arches 114, 116 and 118 provide strength and ridgity to the thin walled cover 100 and resist downward deflection of the cover under the weight of the top fill soil which is on top of the cover. Consequently the size of the liquid storage area defined by pipe units 22 and 24 and chamber 28 is not reduced during use and the efficiency of the drainage system is maximized.

It is apparent that the novel reinforced covers 40 and 100 are substantial improvements over the prior art cover illustrated in FIGS. 12–14 which experiences substantial bending and deflection under the weight of a top fill soil thereby causing the reduction in the size of the liquid storage area including chamber 28. In contrast, the covers 40 and 100 are substantially thinner but yet are significantly stronger and experience virtually no downward deflection thereby avoiding any reduction in size of chamber 28.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A drainage system for delivering fluid from a source of fluid for absorption into the ground, comprising a trench;

a pair of perforated drainage conduits extending longitudinally in said trench and laterally spaced from each other to define an open chamber therebetween, said conduits being connected at one end to said source for receiving fluid from said source and delivering fluid to said chamber;

a longitudinally extending cover overlying said conduits;

top soil placed on top of said cover to substantially fill said trench;

said cover preventing said top soil from falling into said chamber and including a plurality of retaining sections having radiused side portions engaging said conduits and a radiused center portion connected to said side portions and maintaining said conduits in laterally spaced relationship, said cover also including a plurality of reinforcing arched sections connected to said retaining sections in alternating fashion along the longitudinal axis of the cover, each of said reinforcing sections being formed on a single radiused arch extending across the width of the cover, the top of the reinforcing arched sections being generally higher than the top of the retaining sections to form a generally undulating configuration along the length of the cover, whereby downward deflection of said cover is resisted under the weight of said top soil to substantially maintain the size of said chamber.

2. The drainage system of claim 1, said cover including a plurality of openings to vent said chamber.

3. The drainage system of claim 2, wherein said openings are smaller than the particles of top soil.

4. The drainage system of claim 1, wherein each of said drainage conduits is a pre-assembled drainage line unit comprising a horizontally extending perforated pipe connected in fluid communication with the source, a loose aggregation of discrete, crush resistant, lightweight elements surrounding the pipe, and a perforated sleeve member enveloping the aggregation and bounding the same to the pipe.

5. The drainage system of claim 4, wherein said side portions of said retaining sections include downwardly depending lugs which project into said pre-assembled drainage line units.

6. A drainage system for delivering fluid from a source of fluid for absorption into the ground, comprising a trench;

a pair of perforated drainage conduits extending longitudinally in said trench and laterally spaced from each other to define an open chamber therebetween, said conduits being connected at one end to said source for receiving fluid from said source and delivering fluid to said chamber;

a longitudinally extending cover overlying said conduits;

top soil placed on top of said cover to substantially fill said trench;

said cover preventing said top soil from falling into said chamber and including a plurality of retaining sections having radiused side portions engaging said conduits and a radiused center portion connected to said side portions and maintaining said conduits in laterally spaced relationship, said cover also including a plurality of reinforcing arched sections connected to said retaining sections in alternating fashion along the longitudinal axis of the cover, each of said reinforcing sections including a pair of radiused side arches connected to a radiused center arch, the top of the arches being generally higher than the top of the side and center portions of the retaining sections to form a generally undulating configuration along the length of the cover, whereby downward deflection of said cover is resisted under the weight of said top soil to substantially maintain the size of said chamber.

7. The drainage system of claim 6, said cover including a plurality of openings to vent said chamber.

8. The drainage system of claim 7, wherein said openings are smaller than the particles of top soil.

9. The drainage system of claim 6, wherein each of said drainage conduits is a pre-assembled drainage line unit comprising a horizontally extending perforated pipe connected in fluid communication with the source, a loose aggregation of discrete, crush resistant, lightweight elements surrounding the pipe, and a perforated sleeve member enveloping the aggregation and bounding the same to the pipe.

10. The drainage system of claim 9, wherein said side portions of said retaining sections include downwardly depending lugs which project into said pre-assembled drainage line units.

11. A cover for use in a drainage system for delivering fluid from a source of fluid for absorption into the ground, the system including a trench, a pair of perforated drainage conduits extending longitudinally in the trench and laterally spaced from each other to define an open chamber therebetween, the conduits being connected at one end to the source for receiving fluid from the source and delivering fluid to the chamber, said cover being adapted to extend over the conduits and to prevent top soil from falling into the chamber;

said cover including a plurality of retaining sections having radiused side portions engaging said conduits and a radiused center portion connected to said side portions and maintaining said conduits in laterally spaced relationship, said cover also including a plurality of reinforcing arched sections connected to said retaining sections in alternating fashion along the longitudinal axis of the cover, each of said reinforcing sections being formed on a single radiused arch extending across the width of the cover, the top of the reinforcing arched sections being generally higher than the top of the retaining sections to form a generally undulating configuration along the length of the cover, whereby downward deflection of said cover is resisted under the weight of said top soil to substantially maintain the size of said chamber.

12. The cover of claim 11, said cover including a plurality of openings to vent said chamber.

13. The cover of claim 12, wherein said openings are smaller than the particles of the top soil.

14. The cover of claim 11, wherein said side portions of said retaining sections include downwardly depending lugs.

15. A cover for use in a drainage system for delivering fluid from a source of fluid for absorption into the ground, the system including a trench, a pair of perforated drainage conduits extending longitudinally in the trench and laterally spaced from each other to define an open chamber therebetween, the conduits being connected at one end to the source for receiving fluid from the source and delivering fluid to the chamber, said cover being adapted to extend over the conduits and to prevent top soil from falling into the chamber;

said cover including a plurality of retaining sections having radiused side portions engaging said conduits and a radiused center portion connected to said side portions and maintaining said conduits in laterally spaced relationship, said cover also including a plurality of reinforcing arched sections connected to said retaining sections in alternating fashion along the longitudinally axis of the cover, each of said reinforcing sections including a pair of radiused side arches connected to a radiused center arch, the top of the arches being generally higher than the top of the side and center portions of the retaining sections to form a generally undulating configuration along the length of the cover, whereby downward deflection of said cover is resisted under the weight of said top soil to substantially maintain the size of said chamber.

16. The cover of claim 15, said cover including a plurality of openings to vent said chamber.

17. The cover of claim 16, wherein said openings are smaller than the particles of the top soil.

18. The cover of claim 15, wherein said side portions of said retaining sections include downwardly depending lugs.

* * * * *